US011773655B2

(12) United States Patent
Niu

(10) Patent No.: US 11,773,655 B2
(45) Date of Patent: Oct. 3, 2023

(54) INTEGRATED WHIPSTOCK AND SEPARATION METHOD THEREOF

(71) Applicant: Hebei Zhongrong Petroleum Machinery Co., Ltd., Shijiazhuang (CN)

(72) Inventor: Sujie Niu, Shijiazhuang (CN)

(73) Assignee: Hebei Zhongrong Petroleum Machinery Co., Ltd., Shijazhuang (CN)

( * ) Notice: Subject to any disclaimer, the term of this patent is extended or adjusted under 35 U.S.C. 154(b) by 0 days.

(21) Appl. No.: 17/727,753

(22) Filed: Apr. 24, 2022

(65) Prior Publication Data

US 2022/0389771 A1 Dec. 8, 2022

Related U.S. Application Data

(63) Continuation of application No. PCT/CN2021/119911, filed on Sep. 23, 2021.

(30) Foreign Application Priority Data

Jun. 2, 2021 (CN) ..... 202121225794.3

(51) Int. Cl.
*E21B 17/02* (2006.01)
*E21B 17/042* (2006.01)
*E21B 29/06* (2006.01)

(52) U.S. Cl.
CPC ..... *E21B 17/021* (2013.01); *E21B 17/042* (2013.01); *E21B 29/06* (2013.01)

(58) Field of Classification Search
CPC ..... E21B 29/06
See application file for complete search history.

(56) References Cited

U.S. PATENT DOCUMENTS

| | | | |
|---|---|---|---|
| 8,469,096 | B2 | 6/2013 | Mcgarian |
| 9,206,648 | B2 | 12/2015 | Dewey et al. |
| 9,371,695 | B2 | 6/2016 | Zhang et al. |
| 2010/0012322 | A1 | 1/2010 | Mcgarian |

(Continued)

FOREIGN PATENT DOCUMENTS

| | | | |
|---|---|---|---|
| CN | 102364029 | A | 2/2012 |
| CN | 104246108 | A | 12/2014 |
| CN | 206571423 | U | 10/2017 |

OTHER PUBLICATIONS

Internation Search Report of PCT/CN2021/119911, dated Mar. 4, 2022.

*Primary Examiner* — Kristyn A Hall

(57) ABSTRACT

The present disclosure relates to the technical field of multilateral well drilling, and proposes an integrated whipstock. The integrated whipstock includes a setting body; a whipstock body, provided on the setting body and having a whipstock face; a window mill, located at one side of the whipstock face; and screws, connecting the whipstock body to the window mill, where the whipstock face is provided with slots, and the window mill is provided with protrusions, and the protrusions are configured to be snapped into the slots. With the above technical solution, the present disclosure solves the technical problems in the related art that the integrated whipstock cannot go downhole smoothly and the screws are not easy to be sheared during the setting process.

9 Claims, 6 Drawing Sheets

(56) References Cited

U.S. PATENT DOCUMENTS

| | | | | |
|---|---|---|---|---|
| 2013/0213654 | A1 | 8/2013 | Dewey et al. | |
| 2014/0182944 | A1 | 7/2014 | Zhang et al. | |
| 2021/0301615 | A1* | 9/2021 | Harrington | E21B 29/06 |

* cited by examiner

INTEGRATED WHIPSTOCK AND SEPARATION METHOD THEREOF

CROSS-REFERENCE TO RELATED APPLICATIONS

This application is a continuation of International Patent Application No. PCT/CN2021/119911 with a filing date of Sep. 23, 2021, designating the United States, now pending, and further claims priority to Chinese Patent Application No. 202121225794.3 with a filing date of Jun. 2, 2021. The content of the aforementioned applications, including any intervening amendments thereto, are incorporated herein by reference.

TECHNICAL FIELD

The present disclosure relates to the technical field of multilateral well drilling, and in particular to an integrated whipstock.

BACKGROUND ART

The technology of directional wells and horizontal wells has been improving, but due to the limitation of the surface well pattern, it is impossible to deploy more adjustment wells. As an extension of directional wells, lateral wells are formed by using the casing of old wells to cut windows and sidetrack. They can effectively realize the secondary utilization of old wells, and thus are receiving increasing attention. The whipstock is used to guide the window mill to cut the casing of the old well for sidetracking. It is the key tool for lateral well drilling technology and plays a vital role in the drilling and completion of the lateral well.

There are integrated (FIGS. 1 and 2) and split whipstocks, depending on whether the whipstock is integrally connected to the window mill. In the related art, the whipstock body and the window mill are connected by multiple screws. Due to the complicated actual situation downhole, the shear strength on the screws during the descending process is not easy to control. If the screws are high-strength screws and can withstand a large shear force, they will not be easy to be sheared after setting, making it difficult to separate the whipstock body from the window mill. If the screws are low-strength screws and can withstand a small shear force, they will break prematurely in case of an obstruction encountered during the descending process or additional bending moment generated due to the large inclination of the well. Therefore, the related art cannot guarantee the safe descending of the integrated whipstock, the reliable setting, and the smooth separation of the window mill, which has plagued downhole operations.

SUMMARY

The present disclosure proposes an integrated whipstock, which solves the technical problems in the related art that the integrated whipstock cannot go downhole smoothly and the screws are not easy to be sheared during the setting process.

The technical solution of the present disclosure is as follows:

An integrated whipstock includes:

a setting body;

a whipstock body, provided on the setting body and having a whipstock face;

a window mill, located at one side of the whipstock face; and screws, connecting the whipstock body to the window mill;

where, the whipstock face is provided with slots, and the window mill is provided with protrusions; and the protrusions are configured to be snapped into the slots.

Further, the slots are designed as internal threads, and the protrusions are designed as external threads.

Further, a central axis of the internal threads and a central axis of the external threads are coaxial with a central axis of the window mill; and a split sleeve is formed at one end of the whipstock face away from the setting body, and the internal threads are formed on the split sleeve; and the external threads are formed on the window mill.

Further, the protrusions are designed as multiple arc-shaped protrusions juxtaposed in sequence, and the slots are designed as multiple arc-shaped slots juxtaposed in sequence.

Further, a mating cylindrical face is formed on the window mill; the external threads are located on the mating cylindrical face; and after the external threads are connected to the internal threads, the mating cylindrical face is fitted with the split sleeve.

Further, the window mill includes a front end portion, a reducing portion and a rear end portion, which are connected in sequence; the external threads are provided on an outer wall of the reducing portion; a maximum diameter of the front end portion is larger than an external diameter of the external threads; and a maximum diameter of the rear end portion is larger than the maximum diameter of the front end portion.

Further, the split sleeve is arc-shaped, and encloses more than half of the reducing portion of the window mill.

Further, the external threads are full threads, and the internal threads are partial threads with more than a half turn; and the split sleeve is semi-arc-shaped, and has extended sides at two ends.

Further, the whipstock body is provided with a cavity;

the integrated whipstock further includes a central tube, which is provided on the whipstock body and extends into the cavity; and the window mill is provided with a cavity having a connection port; one end of the central tube extends into the connection port to communicate with the cavity; and the central tube is slidable relative to the connection port.

A separation method of the integrated whipstock includes the following steps:

S1: setting the setting body in a wellbore;

S2: rotating the window mill to shear the screws;

S3: continuing to rotate the window mill to separate the protrusions from the slots;

S4: lifting up the window mill to separate the window mill from the central tube;

S5: establishing drilling fluid circulation in the window mill;

S6: lifting up and rotating the window mill to destroy one of the protrusions on the whipstock face; and S7: descending and rotating the window mill to continuously destroy one of the protrusions on the whipstock face until the entire window mill passes through the protrusions, thereby separating the window mill from the whipstock body.

The working principle and beneficial effects of the present disclosure are as follows:

The present disclosure proposes an integrated whipstock, which solves the technical problems in the related art that the integrated whipstock cannot go downhole smoothly and the screws are not easy to be sheared during the setting process. A whipstock face is provided with slots, and a window mill is provided with protrusions. The slots and the protrusions are connected by radial insertion or circumferential rotation of the window mill. Therefore, it is not possible to limit the radial movement or the axial rotation of the slots and the protrusions for separation, but only the relative movement of the slots and the protrusions along an axial direction of the window mill. Through the cooperation of the slots and the protrusions, screws can be designed in an easy-to-shear structure and size. The screws can be designed thinner and the number of the screws can be reduced. Premature screw breakage can be avoided even with easy-to-shear copper screws rather than steel screws. Therefore, the present disclosure effectively solves the problem of difficult screw shearing. Since the screws are matched with the slots and the protrusions, the present disclosure avoids the whipstock body and the window mill from shaking relative to each other during operation, and prevents the screws from being sheared prematurely.

BRIEF DESCRIPTION OF THE DRAWINGS

The present disclosure is described in further detail below with reference to the drawings and specific implementations.

Figure 1:
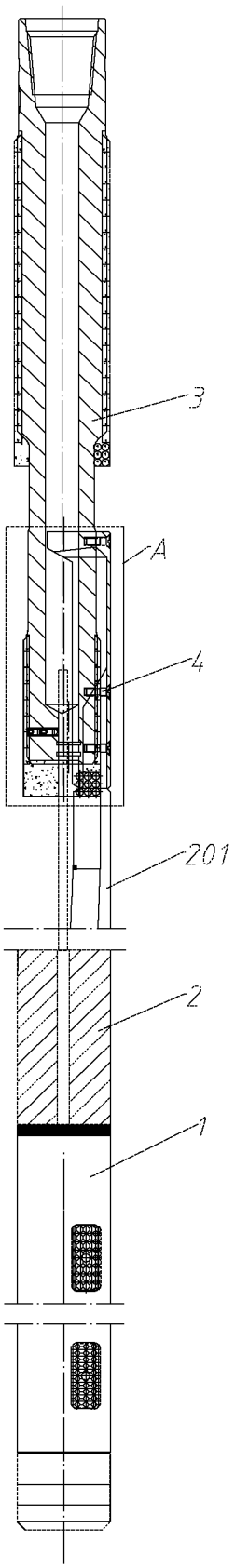
FIG. 1 is a structural diagram of an integrated whipstock in the related art.

Reference Numerals: 1. setting body; 2. whipstock body; 201. whipstock face; 202. slot; 203. split sleeve; 204. extended side; 3. window mill; 301. protrusion; 302. mating cylindrical face; 303. front end portion; 304. rear end portion; 305. reducing portion; 4. screw; 5. internal threads; 6. external threads; 8. cavity of whipstock body; 9. central tube; 10. cavity of window mill; and 11. connection port.

DETAILED DESCRIPTION OF THE EMBODIMENTS

The following clearly and completely describes the technical solutions in the embodiments of the present disclosure with reference to the embodiments of the present disclosure. Apparently, the described embodiments are merely a part rather than all of the embodiments of the present disclosure. All other embodiments obtained by those of ordinary skill in the art based on the embodiments of the present disclosure without creative efforts should fall within the protection scope of the present disclosure.

Figure 2:
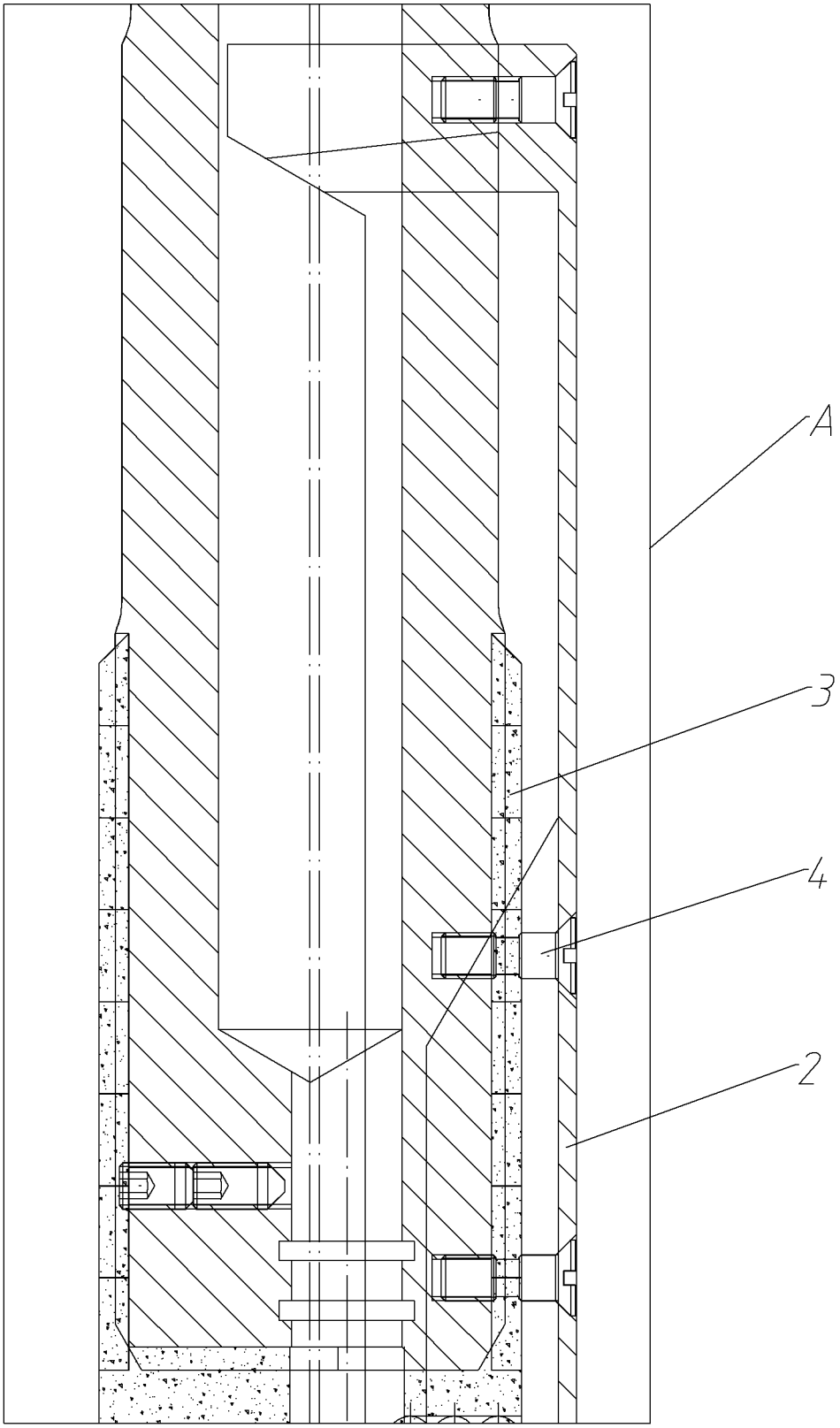
FIG. 2 is a detail of A shown in FIG. 1.

FIGS. 1 and 2 show an integrated whipstock used for multilateral well drilling in the related art. The integrated whipstock is usually connected by multiple screws 4. The problems of this connection method are described in detail in the background. In conclusion, the screws 4 are problematic regardless of whether they are thick with a high strength or thin with a low strength. For example, the screws 4 are not easy to be sheared, or they are broken prematurely to make the setting fail. To this end, the present disclosure makes the following improvements to the technical solutions.

Embodiment 1

Figure 3:
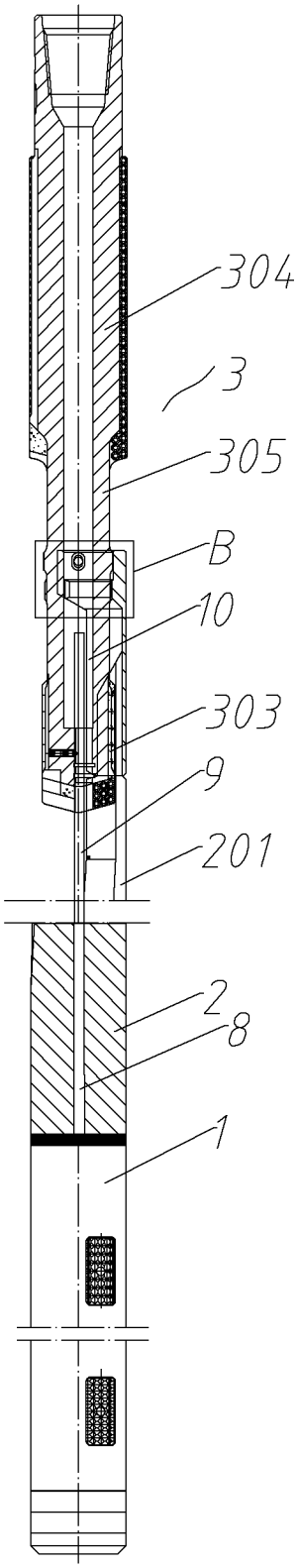
FIG. 3 is a structural diagram of an integrated whipstock according to the present disclosure.
Figure 4:
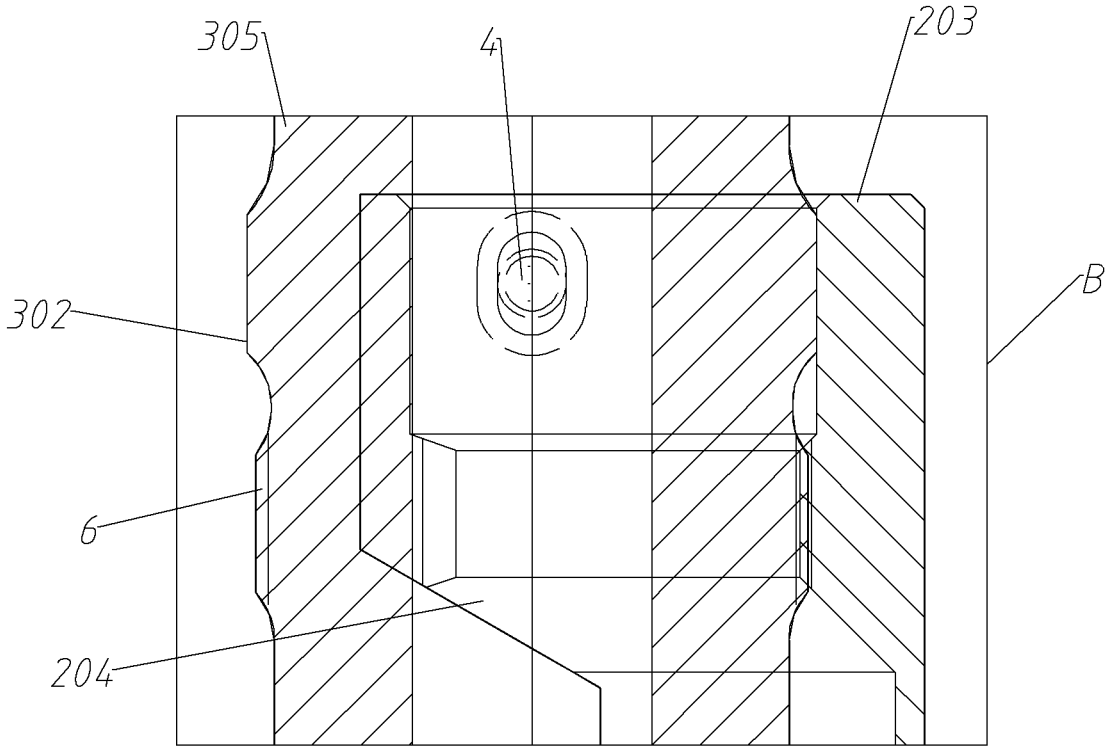
FIG. 4 is a detail of B shown in FIG. 3.
Figure 5:
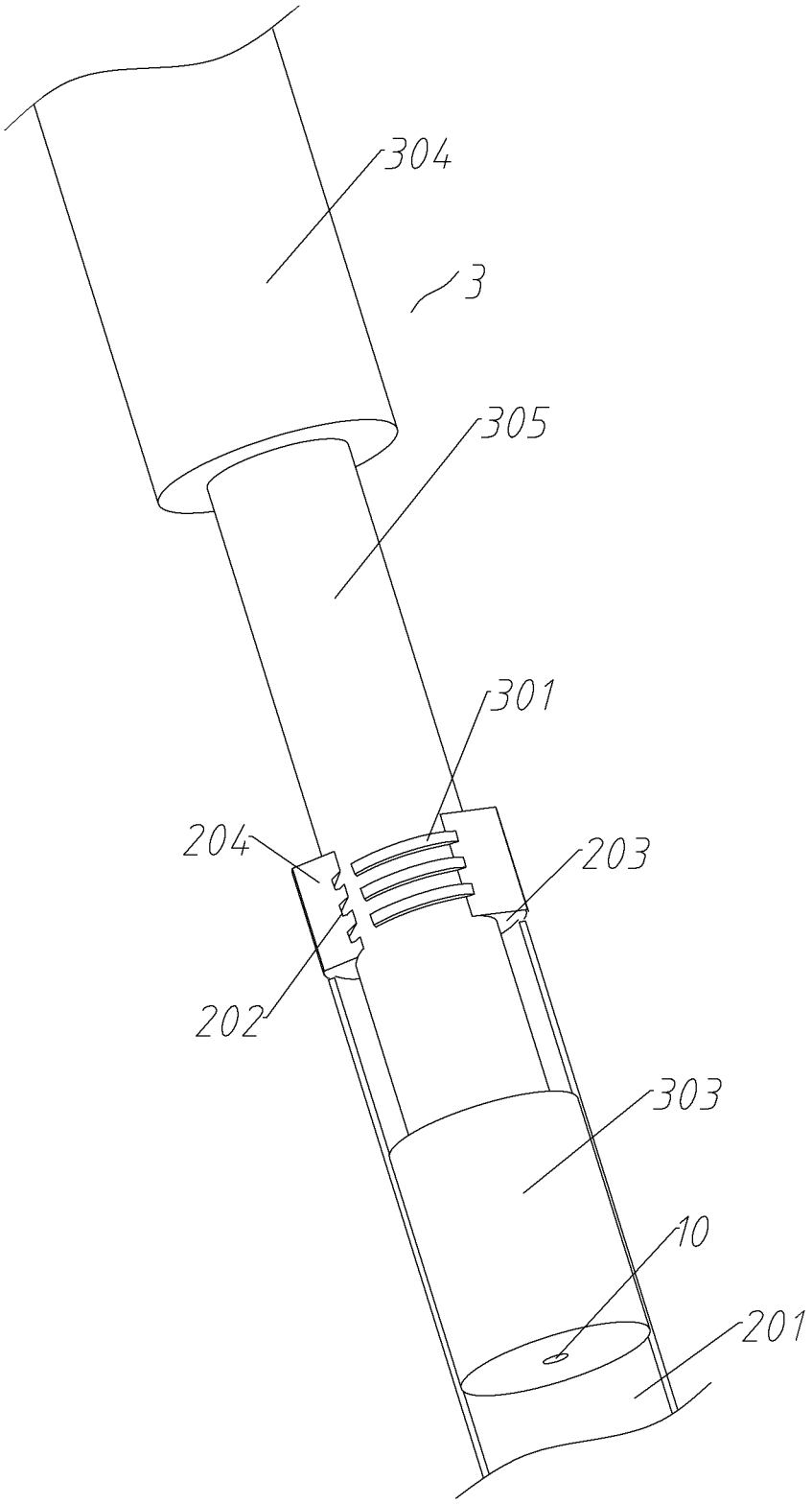
FIG. 5 is a structural diagram of a window mill according to an implementation of the present disclosure.

As shown in FIGS. 3 to 5, this embodiment proposes an integrated whipstock, including:

- a setting body 1;
- a whipstock body 2, provided on the setting body 1 and having a whipstock face 201;
- a window mill 3, located at one side of the whipstock face 201; and
- screws 4, connecting the whipstock body 2 to the window mill 3;
- where, the whipstock face 201 is provided with slots 202, and the window mill 3 is provided with protrusions 301, and the protrusions 301 are configured to be snapped into the slots 202.

This embodiment proposes an integrated whipstock, which achieves the technical effects that the screws 4 are easy to be sheared and not sheared prematurely. The whipstock face 201 is provided with the slots 202, and the window mill 3 is provided with the protrusions 301. The slots 202 and the protrusions 301 are connected by radial insertion or circumferential rotation of the window mill 3. Therefore, it is not possible to limit the radial movement or the axial rotation of the slots and the protrusions for separation, but only the relative movement of the slots and the protrusions along an axial direction of the window mill 3. Through the cooperation of the slots 202 and the protrusions 301, screws 4 can be designed in an easy-to-shear structure and size. The screws 4 can be designed thinner and the number of the screws can be reduced. Premature screw breakage can be avoided even with easy-to-shear copper screws rather than steel screws. Therefore, this embodiment effectively solves the problem of difficult screw shearing. Since the screws 4 are matched with the slots 202 and the protrusions 301, this embodiment avoids the whipstock body 2 and the window mill 3 from shaking relative to each other during operation, and prevents the screws 4 from being sheared prematurely.

When the whipstock as a whole goes down to a preset position and the setting body 1 is set, a drill pipe drives the window mill 3 to rotate so as to shear the screws 4. The separation between the slots 202 and the protrusions 301 can be realized by axial rotation or by relative radial movement of the window mill 3 and the whipstock body 2. The slots 202 and the protrusions 301 do not limit the relative rotation of the window mill 3 and the whipstock body 2. The screws 4 are sheared by the relative rotation of the window mill 3 and the whipstock body 2, and then the slots 202 are separated from the protrusions 301.

Embodiment 2

Figure 6:
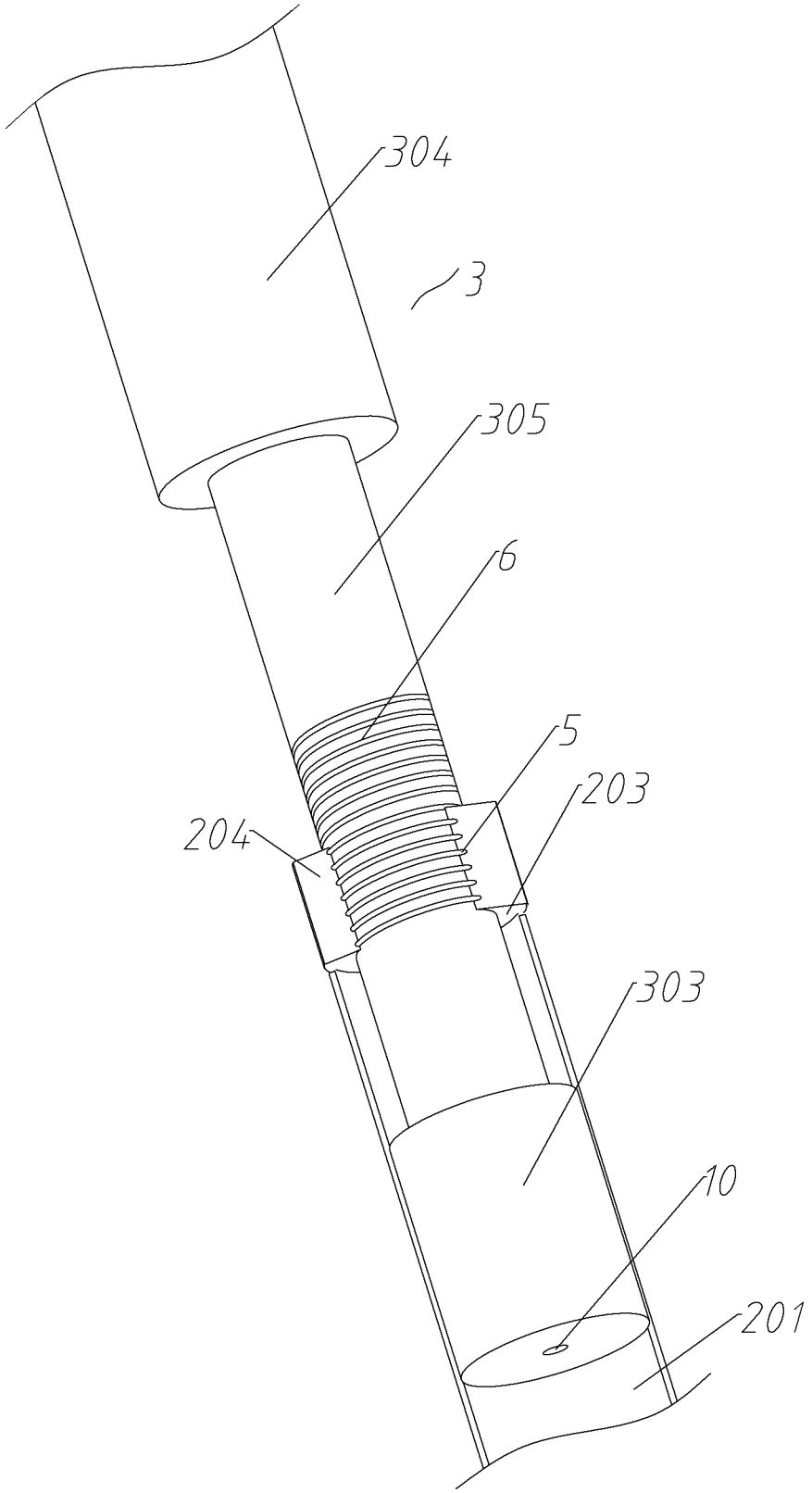
FIG. 6 is a structural diagram of a window mill according to another implementation of the present disclosure.

As shown in FIGS. 3, 4 and 6, on the basis of Embodiment 1, the slots 202 are designed as internal threads 5, and the protrusions 301 are designed as external threads 6. That is, the internal threads 5 and the external threads 6 are a more specific form of the protrusions 301 and the slots 202. The threads are a special kind of slots and protrusions.

In this embodiment, specifically, the whipstock face 201 and the window mill 3 are connected through the internal threads 5 and the external threads 6. The multi-turn threads can bear a large axial force, which makes the axial fixing structure more stable and facilitates the separation of the window mill 3 and the whipstock body 2. Meanwhile, the shearing process of the screws 4 can also be very smooth, which ensures that the screws 4 are easy to be sheared after setting. Specifically, when the window mill 3 and the whipstock face 201 need to be separated, the screws 4 can be sheared by simply rotating the window mill 3. Then, the rotation is continued till a required number of turns to disengage the window mill from the threaded connection, thereby realizing the separation of the window mill and the whipstock face. Compared with the basic protrusions 301 and slots 202 in Embodiment 1, this embodiment achieves a more stable connection and more convenient separation, and avoids the problem of premature breakage of the screws.

Central axes of the internal threads 5 and the external threads 6 can be designed to be coaxial with that of the window mill 3. In this way, rotating the window mill 3 can release the threaded connection between the window mill 3 and the whipstock body 2. The direction of the threads is designed as required to achieve the separation of the window mill 3 and the whipstock body 2.

Embodiment 3

As shown in FIG. 5, on the basis of Embodiment 1, the protrusions 301 are designed as multiple arc-shaped protrusions 301 juxtaposed in sequence, and the slots 202 are designed as multiple arc-shaped slots 202 juxtaposed in sequence.

In this embodiment, the whipstock face 201 is provided with slots 202, and the window mill 3 is provided with protrusions 301, and the protrusions 301 are configured to be snapped into the slots 202. The purpose of this design is to limit the relative axial displacement between the whipstock face 201 and the window mill 3, so as to prevent the screws 4 from being sheared prematurely. In this embodiment, the protrusions 301 are designed as arc-shaped protrusions 301, and the slots 202 are designed as arc-shaped slots 202. By doing so, the relative axial displacement between the whipstock face 201 and the window mill 3 is limited, and the arc-shaped protrusions 301 can be separated from the arc-shaped slots 202 by rotating the window mill 3. Therefore, this design facilitates the separation, ensures the stability of the integrated whipstock in the process of going downhole, and avoids premature breakage of the screws. The arc-shaped protrusions 301 and the arc-shaped slots 202 can be designed to be a half turn or shorter, as long as they can be separated after rotation.

Embodiment 4

As shown in FIGS. 3 to 4 and FIG. 6, on the basis of Embodiment 2, further, a split sleeve 203 is formed at one end of the whipstock face 201 away from the setting body 1, and the internal threads 5 are formed on the split sleeve 203. There are multiple screws 4, and one of the screws 4 is connected to the window mill 3 through the split sleeve 203. The external threads 6 are formed on the window mill 3.

In this embodiment, in order to further ensure the relative stability between the whipstock body 2 and the window mill 3 and avoid shaking causing the screws 4 to be sheared prematurely, the split sleeve 203 is specially designed to form the internal threads 5 connected to the external threads 6 on a shank body portion of the window mill 3. The split sleeve 203 plays a role of supporting the window mill 3.

Further, a mating cylindrical face 302 is formed on the window mill 3. The external threads 6 are located on the mating cylindrical face 302, and after the external threads 6 are connected to the internal threads 5, the mating cylindrical face 302 is fitted with the split sleeve 203.

In this embodiment, in order to realize the simultaneous application of the threads and the screws 4 and avoid the shaking between the whipstock body 2 and the window mill 3, the mating cylindrical face 302 is specially designed, which is an annular bead. After the internal threads 5 and the external threads 6 are connected, the mating cylindrical face 302 is fitted with the split sleeve 203. The supporting action of the connected internal threads and external threads 6 and the supporting action of the mating cylindrical face 302 cooperate with each other, such that the connection between the window mill 3 and the whipstock body 2 is more stable.

Further, the window mill 3 includes a front end portion 303, a reducing portion 305 and a rear end portion 304, which are connected in sequence. The external threads 6 are provided on an outer wall of the reducing portion 305. A maximum diameter of the front end portion 303 is larger than an external diameter of the external threads 6. A maximum diameter of the rear end portion 304 is larger than the maximum diameter of the front end portion 303.

The split sleeve 203 is arc-shaped, and it encloses more than half of the reducing portion 305 of the window mill 3.

In this embodiment, in order to further improve the stability and reliability of the integrated whipstock during the descending process, a further structure is added. When the setting body 1 does not reach a set target, even if the screws 4 of a first line of defense are sheared prematurely and the protrusions 301 of a second line of defense escape from the slots 202 prematurely, there is also a third line of defense to prevent the whipstock body 2 and the window mill 3 from being completely separated. Specifically, the third line of defense is that the window mill 3 includes the front end portion 303, the reducing portion 305 and the rear end portion 304, which are connected in sequence. The split sleeve 203 is designed in an arc shape, so as to form a semi-enclosed structure, enclosing half of the reducing portion 305. Therefore, even if there is a problem with the first two lines of defense, the front end portion 303 can still be clamped on the arc-shaped split sleeve 203, such that the whipstock body 2 can still be hung on the front end portion 303 through the arc-shaped split sleeve 203. This design can avoid serious accidents caused by the whipstock body 2 separated from the window mill 3 and falling to the bottom of the well, thereby improving the stability and safety of the operation.

During the descending of the integrated whipstock, the three lines of defense are required to stabilize the connection between the setting body 1 and the window mill 3. However, it should be noted that after the setting body 1 is set, all the three lines of defense need to be removed. The specific removal of the first two lines of defense is as follows. After the setting body 1 is set in a wellbore, the window mill 3 is rotated, such that the screws 4 connected to the window mill 3 through the split sleeve 203 are sheared, thereby removing the first line of defense. The window mill 3 is continuously rotated multiple times to disengage the external threads 6 from the internal threads 5, thereby removing the second line of defense.

As described in detail above, after removing the first line of defense of the screws 4 and the second line of defense of the external threads 6 and the internal threads 5, the front end portion 303 can still be clamped on the arc-shaped split sleeve 203, and the whipstock body 2 can still be hung on the front end portion 303 through the arc-shaped split sleeve 203. Therefore, it is necessary to destroy the arc-shaped split sleeve 203 with the internal threads 5 so as to prevent the split sleeve 203 with a semi-enclosed structure from affecting the travel of the window mill 3, especially the travel of the rear end portion 304. Specifically, the split sleeve 203 is broken from the internal threads 5 on an inner wall until the rear end portion 304 can pass through to carry out the subsequent travel along the whipstock face 201. The diameter of the rear end portion 304, which is the main working part of the window mill 3, is generally larger than that of the internal threads 5. Therefore, it is difficult to directly damage the arc-shaped split sleeve through the rear end portion 304. However, failure to do so will affect the travel of the rear end portion 304.

To this end, the front end portion 303 is specially designed. It has the same cylindrical structure as the rear end portion 304 and the reducing portion 305. The diameter of the front end portion 303 is larger than the diameter of the reducing portion 305 and smaller than the diameter of the rear end portion 304. The split sleeve 203 with the semi-enclosed structure can be hung on the front end portion 303 to prevent the whipstock body 2 from falling into the bottom of the well. The front end portion 303 can also be lifted and rotated to destroy the split sleeve 203 with the semi-enclosed structure from the internal threads 5, such that the internal diameter of the split sleeve 203 is closer to the diameter of the rear end portion 304. Therefore, in the next step, the rear end portion 304 can be moved down and rotated to further destroy the inner wall of the split sleeve 203. That is, the rear end portion 304 can move down and pass through the split sleeve 203 with the semi-enclosed structure so as to destroy the third line of defense. After that, the rear end portion is guided to travel along the whipstock face 201, so as to perform the subsequent window cutting and sidetracking operations. Therefore, this embodiment realizes the connection of the three lines of defense required for the descending process and the disconnection of the three lines of defense required after setting, so as to ensure the stability and achievability of the overall operation.

Further, the external threads 6 are full threads, and the internal threads 5 are partial threads with more than a half turn. The split sleeve 203 is semi-arc-shaped, and has extended sides 204 at two ends.

In this embodiment, in order to realize the efficient separation of the window mill 3 and the whipstock body 2 after the setting of the setting body 1 is completed at a preset position, the internal threads 5 can be specially designed as partial threads. Thus, after the screws 4 are sheared, the external threads 6 are easily separated from the internal threads 5 to ensure the subsequent window cutting and sidetracking operations. The split sleeve 203 is semi-arc-shaped, and two ends of the split sleeve 203 are further provided with extended sides 204. This design facilitates the entry of the window mill 3. The front end portion 303 can be hung on the split sleeve 203 and the extended sides 204 on the two sides thereof when necessary, thereby improving the construction stability. It should be noted that the partial threads may have at least a half turn, or may have a two-thirds or three-fifths turn. The threads of different sizes can meet a variety of connection strength requirements. Further, there are multiple screws 4, one of which passes through the split sleeve 203 and the mating cylindrical face 302, so as to achieve a better connection effect.

In this embodiment, in order to prevent the screws from loosening caused by vibration of the integrated whipstock during the process of going downhole, the screws 4 are specially designed. They are installed at the split sleeve 203 of the whipstock body 2 and the external threads 6 of the window mill 3, or at the split sleeve 203 of the whipstock body 2 and the mating cylindrical face 302 of the window mill 3. They are configured to fix the whipstock body 2 and the window mill 3 to make the structure more stable.

Further, the whipstock body 2 is provided with a cavity 8.

The integrated whipstock further includes a central tube 9, which is provided on the whipstock body 2 and extends into the cavity 8.

The window mill 3 is provided with a cavity 10. A connection port 11 is provided in the cavity 10. One end of the central tube 9 extends into the connection port 11 to communicate with the cavity 10. The central tube 9 is slidable relative to the connection port 11.

The cavity 8 of the whipstock body is usually a central through hole along the axial direction of the whipstock body, which is configured to transport a drilling fluid to the setting body 1 to provide a fluid pressure required for setting. The cavity 10 of the window mill is also usually a central through hole along the axial direction of the window mill, which is configured to smoothly establish drilling fluid circulation during a drilling process. This design is in the prior art and will not be repeated herein.

In this embodiment, the whipstock body 2 is provided with the cavity 8, and the window mill 3 is provided with the cavity 10 and the connection port 11. One end of the central tube 9 is fixed to the whipstock body 2 and extends into the cavity 8 of the whipstock body. The other end of the central tube 9 extends into the connection port 11, communicates with the cavity 10 of the window mill, and is slidable relative to the window mill 3. The window mill 3 can be completely pulled out of the central tube 9. When the window mill 3 is pulled up, the cavity 10 of the window mill slides to be separated from the central tube 9, such that the cavity 10 of the window mill is separated from the central tube by a certain distance. The drilling fluid flows from a gap into a cavity around the wellbore, thereby establishing the drilling fluid circulation. Therefore, subsequently, the front end portion 303 can be lifted up to destroy the internal threads 5, so as to avoid serious engineering accidents caused by lack of drilling fluid circulation for destroying the internal threads.

Embodiment 5

This embodiment provides a separation method of the integrated whipstock, which includes the following steps:

S1. Set the setting body 1 in a wellbore, where the whipstock face 201 is provided with the protrusions 301, and the window mill 3 is provided with the slots 202, and the protrusions 301 are snapped into the slots 202.

S2. Rotate the window mill 3 to shear the screws 4.

S3. Continue to rotate the window mill 3 to separate the protrusions 301 from the slots 202.

S4. Lift up the window mill 3 to separate the window mill 3 from the central tube 9.

S5. Establish drilling fluid circulation.

S6. Lift up and rotate the window mill 3 to the whipstock face 201, such that one of the protrusions 301 or the slots 202 on the whipstock face 201 is destroyed.

S7. Descend and rotate the window mill 3 to the whipstock face 201, such that one of the protrusions 301 or the slots 202 is continued to be destroyed until the entire window mill 3 passes through the protrusions 301 or the slots 202, so as to realize the separation of the window mill 3 and the whipstock body.

In this embodiment, in order to enable the window mill 3 to be smoothly separated along the whipstock face 201 after setting to conduct multilateral well drilling, after the setting body 1 is set at a preset position in a wellbore, the window mill 3 needs to be rotated to shear the screws 4 and disengage the protrusions 301 from the slots. When the protrusions 301 and the slots 202 are respectively designed as external threads 6 and internal threads 5 that cooperate with each other, the window mill 3 can be rotated along the threads to rise. When the window mill is rotated, the window mill shears the screws 4 first. Then, the window mill 3 is continuously rotated and raised along the threads until the external threads 6 and the internal threads 5 are disengaged. When the protrusions 301 and the slots 202 are respectively designed as small enough external threads 6 and internal threads 5, after the window mill 3 is rotated to shear the screws 4, the external threads and the internal threads can be disengaged by simply rotating the window mill or simply lifting the window mill without rotation.

Afterwards, it may be necessary to destroy the external threads 6 and the internal threads 5 so as not to affect the travel of the window mill 3. First, the drilling fluid circulation is established. The window mill 3 is continuously lifted up. The cavity 10 of the window mill 3 is separated from the central tube 9. The window mill 3 is rotated and lifted up. The front end portion 303 destroys one of the internal threads 5 on the whipstock face 201. Then the window mill 3 is rotated to descend. The rear end portion 3041 continues to destroy a part of the whipstock face 201, such that the entire window mill 3 can pass through the semi-arc-shaped split sleeve 203, thereby separating the window mill 3 from the whipstock body. The design ensures the stability of the entire integrated whipstock during the descending process, and also well realizes the separation of the whipstock body 2 and the window mill 3.

The above described are merely preferred embodiments of the present disclosure, and not intended to limit the present disclosure. Any modifications, equivalent replacements and improvements made within the spirit and principle of the present disclosure should all fall within the scope of protection of the present disclosure.

What is claimed is:

1. An integrated whipstock, comprising:

a setting body (1);

a whipstock body (2), provided on the setting body (1) and having a whipstock face (201);

a window mill (3), located at one side of the whipstock face (201); and screws (4), connecting the whipstock body (2) to the window mill (3);

wherein, the whipstock face (201) is provided with slots (202), and the window mill (3) is provided with protrusions (301); the slots (202) are designed as internal threads (5), and the protrusions (301) are designed as external threads (6); and the protrusions (301) are connected with the slots (202) through rotation.

2. The integrated whipstock according to claim 1, wherein a central axis of the internal threads (5) and a central axis of the external threads (6) are coaxial with a central axis of the window mill (3); and a split sleeve (203) is formed at one end of the whipstock face (201) away from the setting body (1), and the internal threads (5) are formed on the split sleeve (203); and the external threads (6) are formed on the window mill (3).

3. The integrated whipstock according to claim 2, wherein a mating cylindrical face (302) is formed on the window mill (3); the external threads (6) are located on the mating cylindrical face (302); and after the external threads (6) are connected to the internal threads (5), the mating cylindrical face (302) is fitted with the split sleeve (203).

4. The integrated whipstock according to claim 2, wherein the window mill (3) comprises a front end portion (303), a reducing portion (305) and a rear end portion (304), which are connected in sequence; the external threads (6) are provided on an outer wall of the reducing portion (305); a maximum diameter of the front end portion (303) is larger than an external diameter of the external threads (6); and a maximum diameter of the rear end portion (304) is larger than the maximum diameter of the front end portion (303).

5. The integrated whipstock according to claim 4, wherein the split sleeve (203) is arc-shaped, and encloses more than half of the reducing portion (305) of the window mill (3).

6. The integrated whipstock according to claim 2, wherein the external threads (6) are full threads, and the internal threads (5) are partial threads with more than a half turn; and the split sleeve (203) is semi-arc-shaped, and has extended sides (204) at two ends.

7. The integrated whipstock according to claim 1, wherein the protrusions (301) are designed as multiple arc-shaped protrusions juxtaposed in sequence, and the slots (202) are designed as multiple arc-shaped slots juxtaposed in sequence.

8. The integrated whipstock according to claim 1, wherein the whipstock body (2) is provided with a cavity (8);

the integrated whipstock further comprises a central tube (9), which is provided on the whipstock body (2) and extends into the cavity (8); and the window mill (3) is provided with a cavity (10) having a connection port (11); one end of the central tube (9) extends into the connection port (11) to communicate with the cavity (10); and the central tube (9) is slidable relative to the connection port (11).

9. A method for separating the integrated whipstock according to claim 1, comprising the following steps:

S1: setting the setting body (1) in a wellbore;

S2: rotating the window mill (3) to shear the screws (4);

S3: continuing to rotate the window mill (3) to separate the protrusions (301) from the slots (202);

S4: lifting up the window mill (3) to separate the window mill (3) from a central tube (9);

S5: establishing drilling fluid circulation in the window mill (3);

S6: lifting up and rotating the window mill (3) to destroy some of the protrusions (301) on the whipstock face (201); and S7: descending and rotating the window mill (3) to continuously destroy rest of the protrusions (301) on the whipstock face (201) until the entire window mill (3) passes through the protrusions (301), thereby separating the window mill (3) from the whipstock body (2).

* * * * *